US006942900B2

(12) United States Patent
Baumann et al.

(10) Patent No.: US 6,942,900 B2
(45) Date of Patent: Sep. 13, 2005

(54) PROCESS FOR PRODUCING INSULATIONS FOR ELECTRICAL CONDUCTORS BY MEANS OF POWDER COATING

(75) Inventors: Thomas Baumann, Wettingen (CH); Johann Nienburg, Heidelberg (DE); Jörg Oesterheld, Birmenstorf (CH); Jörg Sopka, Schwetzingen (DE)

(73) Assignee: ALSTOM Technology Ltd., Baden (CH)

( * ) Notice: Subject to any disclaimer, the term of this patent is extended or adjusted under 35 U.S.C. 154(b) by 0 days.

(21) Appl. No.: 10/168,625

(22) PCT Filed: Dec. 21, 2000

(86) PCT No.: PCT/CH00/00683

§ 371 (c)(1),
(2), (4) Date: Nov. 12, 2002

(87) PCT Pub. No.: WO01/48763

PCT Pub. Date: Jul. 5, 2001

(65) Prior Publication Data

US 2003/0113539 A1 Jun. 19, 2003

(30) Foreign Application Priority Data

Dec. 28, 1999 (DE) ..... 199 63 378

(51) Int. Cl.[7] ..... B05D 1/02; B05D 1/08; B05D 1/22; B05D 1/38

(52) U.S. Cl. ..... 427/447; 427/185; 427/202; 427/203; 427/379; 427/421

(58) Field of Search ..... 427/459, 461, 427/470, 185, 190, 195, 202–205, 374.2, 379, 421, 454, 118, 120, 447; 252/62; 156/47, 51; 106/447, 429, 465, 471, 487, 467, 479

(56) References Cited

U.S. PATENT DOCUMENTS

| | | | | |
|---|---|---|---|---|
| 4,040,993 A | | 8/1977 | Eibling et al. | |
| 4,088,809 A | * | 5/1978 | Elbling et al. | 428/379 |
| 4,425,374 A | * | 1/1984 | McCutcheon, Sr. | 427/487 |
| 4,760,296 A | * | 7/1988 | Johnston et al. | 310/45 |
| 4,966,928 A | * | 10/1990 | Kitagawa et al. | 523/437 |
| 5,043,401 A | | 8/1991 | Matsuzaki | |

FOREIGN PATENT DOCUMENTS

| | | | |
|---|---|---|---|
| DE | 3933745 A1 | 4/1991 | B05B/15/04 |
| DE | 4037972 A1 | 6/1991 | H01B/3/00 |
| DE | 19701307 A1 | 7/1998 | H01B/19/04 |
| DE | 19706851 A1 | 9/1998 | H02K/1/28 |
| DE | 19817287 A1 | 10/1999 | H02K/3/40 |

OTHER PUBLICATIONS

International Search Report for PCT Patent Application No. PCT/CH00/00683, mailed on Aug. 28, 2001.

* cited by examiner

*Primary Examiner*—Fred J. Parker
(74) *Attorney, Agent, or Firm*—Cermak & Kenealy, LLP; Adam J. Cermak

(57) ABSTRACT

A process for producing insulations for electrical conductors by powder coating, which results in aging which is improved compared to glass-mica or casting-resin insulation, and a powder which is suitable for such a process. The powder is applied a number of times in succession, in the form of individual layers which follow one another, until a layer thickness of ≦10 mm is reached, and each of the individual layers undergoes intermediate heat curing before the next individual layer is applied. The intermediate curing of each individual layer uses a curing time which corresponds to 2–10 times the gel time of the powder used. Finally, the entire insulation undergoes final curing. The result of an electrical life test carried out on various specimens insulated with epoxy-resin powder which contains fine filler.

11 Claims, 1 Drawing Sheet

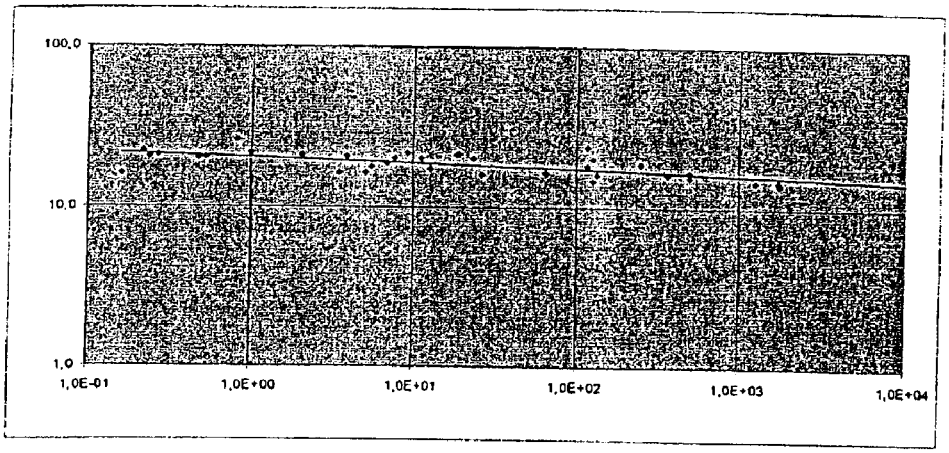
Figure

PROCESS FOR PRODUCING INSULATIONS FOR ELECTRICAL CONDUCTORS BY MEANS OF POWDER COATING

TECHNICAL FIELD

The invention relates to the insulations used for electrical conductors in equipment in the low- to medium-voltage range (i.e. up to approximately 50 kV) produced by powder coating. Insulation in the high-voltage range is also possible, provided that the conductors are not exposed to the entire potential drop. The invention relates in particular to insulations for electrical conductors which are subject to high thermal and electrical loads, such as insulations for electrical conductors or conductor bundles of rotating electrical machines. Further examples of possible applications are switchgear and transformers.

PRIOR ART

The term electrical aging refers to the phenomenon whereby an insulation, under load, has a finite service life which is inversely proportional to the level of the electric field which is active. This relationship between service life and electric field strength is usually described in graph form in the form of an aging curve. This curve can very often be described mathematically as an exponential law, in accordance with $$E = E_0 \cdot \left(\frac{t}{t_0}\right)^{-\frac{1}{n}}$$

where E is the electric field in kV/mm, $E_0$ is the electric field at lifetime $t_0$, t is the time in h, with $t_0$=1 h, and n is the service life coefficient. When E and t are expressed in double logarithm form, the above expression results in a straight line with the gradient −1/n.

The service life coefficient can be considered to be characteristic of the type of insulation. For example, in the case of glass/mica insulation for electrical rotating machines, n=7 to 9, while for epoxy or casting resin insulations used in switchgear, n=12 to 16, and for high-voltage cables which are generally insulated by extrusion, n is ≦35. In technical terms, it is desirable for the aging to be as low as possible, i.e. for it to be possible to achieve a shallow aging curve or the highest possible service life coefficient n, as can be achieved, for example, with cables.

The extrusion process which is used for the production of cable insulations is a continuous process which is particularly suitable for the production of quasi-infinite, geometrically simple structures. However, neither the production process nor the materials used for it—generally unfilled, pure polyethylene—can be used on a wider scale. For example, insulations for complex and small structures, such as for example motor coils or connections in switchgear, cannot be produced by means of this process. Also, the use of polyethylene is unsuitable for many possible applications, since PE insulations of this type can only be used up to approximately 90° C.

Powder coating is known as an insulation process which is largely independent of geometry. Unlike extrusion, this insulation process is suitable even for highly complex conductor structures. In theory, it could be used to effectively and inexpensively insulate a very wide range of medium-voltage equipment for which the extrusion process is unsuitable. However, a current obstacle to widespread use is that the known powder-coating processes and the available coating materials cannot provide insulations of sufficient quality.

The known applications for powder coating are the insulation of the individual conductors of conductor bundles in generators, known as transposed bars, and the insulation of busbars. In both cases, however, the loads on the finished insulation are only weak. The voltage which occurs between the individual conductors of transposed bars is a few volts. Therefore, the insulation itself, given a layer thickness of the subconductor insulation of 50–200 μm, is only subject to weak electrical loads, i.e. with electric fields of E<1 kV/mm.

The production of epoxy resin powders with which a subconductor insulation of this type can be produced by electrostatic spraying or fluidized-bed sintering is known from both U.S. Pat. No. 4,040,993 and U.S. Pat No. 4,088,809. However, these insulations are not suitable for high electric loads of over E>3 kV/mm. Moreover, they can only be used to achieve a low layer thickness of approx. 120 μm (<5 mils).

Since there is no counterelectrode on the surface of the insulation, the insulation in busbars is likewise only subject to weak loads or may even not be subject to any load at all. Therefore, the electric potential of the busbar is reduced virtually completely in the air space above the layer. Consequently, cavities in the epoxy layer are far less disruptive than in the case of the present application. Accordingly, tests carried out with a powder used for busbar coating also revealed an extremely high level of holes.

Similar statements are true of powders which are used to provide small electric motors or parts of these motors with a thin layer of epoxy. This layer primarily has to act to protect against corrosion, and is subject to little if any electrical load.

Powders which satisfy the thermal requirements but are electrically unsuitable are commercially available. Powders of this type are generally used to protect against corrosion in the chemical engineering field. The process for producing such powders by hot mixing, melting, cooling and milling corresponds to the general prior art, as described, for example, in U.S. Pat. No. 4,040,993.

In general, the known powder-coating processes for the production of electrical insulations produce layers with thicknesses of ≦0.1 mm (powder film coating). However, to insulate conductors which are subject to high thermal and electric loads, considerably greater layer thicknesses (e.g. 6 mm for 30 kV with a field strength of 5 V/mm) and an improved service life coefficient are required.

SUMMARY OF THE INVENTION

The invention seeks to avoid all these drawbacks. It is based on the object of providing a process for producing insulations for electrical conductors by means of powder coating which results in aging which is improved compared to glass-mica or casting resin insulation. It is also intended to describe a powder which is suitable for such a process.

According to the principles of the present invention, this is achieved by the fact that, the powder is applied a number of times in succession, in the form of individual layers which follow one another, until a total insulation thickness of ≦10 mm is reached, and each of the individual layers undergoes intermediate heat curing before the next individual layer is applied. The intermediate curing of each individual layer uses a curing time which corresponds to 2–10 times the gel time of the powder used. Finally, the entire insulation undergoes final curing.

The process uses a powder which contains at least one resin-hardener-auxiliary system which can be melted and cured, and at least one inorganic filler. The inorganic filler content is 5–50 per cent by weight, based on a closed density of the filler of up to 4 g/cm$^3$. At least 3 per cent by weight of the total mixture of the powder consists of fine filler with a mean grain size $d_{50}$ of <3 $\mu$m. The remaining filler consists of coarse filler with a mean grain size $d_{50}$ of <30 $\mu$m. In this case, the run of the powder which melts to form a continuous film is at least 25 mm, and the gelation time of the melted powder is at least 40 s.

On account of the repeated application of thin individual layers of the powder and the subsequent intermediate heat curing of these individual layers, on the one hand, due to the associated reduction in the formation of bubbles, an insulation with a considerably improved quality and a service life coefficient which is likewise significantly improved is formed, while on the other hand, this insulation can be reinforced by the application of further individual layers until the layer thickness required for the particular application is reached. The intermediate curing means that in each case the outer individual layer reaches a strength which is sufficiently great for application of the next individual layer, while at the same time it still retains sufficient unbonded hardener to undergo chemical crosslinking with the next individual layer. Not least, the composition of the powder, in particular the inventive proportion of fine filler, also contributes to increasing the service life of the insulation.

Suitable coating processes for applying the powder to the electrical conductors which are to be coated are spray-sintering or fluidized-bed sintering or thermal spraying of powder in the molten state. By selecting resin-hardener-auxiliary systems with a glass transition temperature of the thermoset of at least 130° C., it is possible to ensure that the insulation can be used for all applications in the medium-voltage range.

It is particularly advantageous for the intermediate heat curing of the individual layers to be carried out over a time which corresponds to 3–5 times the gel time of the powder used. In this way, an optimum ratio of strength to the capacity to undergo chemical crosslinking with the next individual layer can be achieved for each individual layer.

It is particularly expedient if the individual layers are applied with the lowest possible layer thickness of ≦0.5 mm down to an optimum layer thickness of 0.2 mm. In this way, it is possible to produce a complete high-quality coating of even complex surfaces and also a layer thickness which is suitable for conductors which are subject to high thermal and electric loads.

Alternatively, it is possible either to apply exclusively individual layers with a uniform layer thickness or individual layers of different layer thicknesses in any desired order to the electrical conductors which are to be insulated. Moreover, powders of different composition can be used for the application of individual layers. This makes it possible to produce an insulation which satisfies the required demands with regard to the conditions of use of the insulated electrical conductors.

The most important demands imposed on the finished insulation are as follows:

1. The insulation is to be capable of being used up to thermal class H, i.e. $T_{max}$=180° C. in long-term operation. Since in electrical engineering it is customary to demand one thermal class as a safety margin, the insulation should satisfy the demands of thermal class C, i.e. $T_{max}$=205° C. This requirement is usually considered to be satisfied if the temperature index (TI) is> operating temperature ($T_{op}$). Standard IEC 218 provides information on determining the TI.
2. The insulation is to be capable of withstanding high electric loads in long-term operation, i.e. with E>3 kV/mm, in particular E≧5 kV/mm. In this case, the field strength E is the effective alternating voltage $U_{eff}$, divided by the thickness d of the insulation on the flat side of the conductor, i.e. $E=U_{eff}/d$. For E=5 kV/mm and a desired maximum voltage of 50 kV, the result is that it must be possible to produce the insulation in thicknesses of up to 10 mm.
3. Low electric losses (recommended value tan δ<0.3) all the way up to the maximum temperature, since the insulation is heated itself at E=5 kV/mm and relatively high dielectric losses, and failure caused by heat breakdown may occur.
4. It should be as far as possible free of cavities (generally inclusions of gas), which during operation can lead to electrical partial discharges (PDs) and premature dielectric failure.
5. It should be resistant to low-energy PDs or surface discharges. This makes the insulation system able to tolerate limited fluctuations in quality.
6. It should be free of sharp-edged, conductive inclusions (e.g. metal chips) which lead to locally greatly increased fields and likewise to premature failure.

BRIEF DESCRIPTION OF THE DRAWING

The only FIGURE shows the results of an electrical life test carried out on various specimens, insulated with epoxy resin powder which has been applied in accordance with the invention and contains fine filler, the life being plotted on the horizontal axis in hours, and the field strength being plotted on the vertical axis in kV/mm.

WAY OF CARRYING OUT THE INVENTION

The polymer-based powder according to the invention contains at least one uncrosslinked system consisting of resin, hardener and auxiliaries, .as well as electrically insulating inorganic fillers. The auxiliaries influence, for example, the curing time or the run; auxiliaries which are known from the prior art can be used. Electrically insulating inorganic fillers are present in amounts of from approximately 5 to approximately 50 per cent by weight, based on fillers with a closed density of up to 4 g/cm$^3$. The filler is present either entirely as a fine filler, with a mean grain size $d_{50}$ of <3 $\mu$m, in particular $d_{50}$<1 $\mu$m, particularly preferably with $d_{50}$ between 0.01 and 0.3 $\mu$m, or as a mixture of fine filler and coarse filler with $d_{50}$<30 $\mu$m, in particular between 3 and 20 $\mu$m. The proportion of fine filler in the total mixture of the powder should be at least 3%, in particular at least 5%, and the polymer which is to be formed from the resin and hardener should be a thermoset which, in the crosslinked state, has a glass transition temperature of at least 130° C.

Preferred fine fillers have a mean diameter $d_{50}$ of approx. 0.2 $\mu$m; it is even possible to use finer fillers, which has a positive effect on the corona resistance but an adverse effect on the flow properties (thixotropy) of the melted insulating material.

It is preferable for the total filler content to be approximately 40%. If the filler has a mean closed density of over 4 g/cm$^3$, the limit and preferred values listed above and below may be higher.

The fine filler and the coarse filler may be different materials which have a different hardness. It is also within the scope of the present invention for the fine filler or the coarse filler or the fine filler and the coarse filler to be mixtures of fillers of the same or a different hardness.

To prevent abrasion during production of the insulating material or its processing to form the insulation, which is of significance in particular now that it is customary to use steel or hard-metal equipment for compounding and milling the insulating material, the coarse filler must have a Mohs hardness which is preferably at least one hardness unit below that of steel and hard metal (Mohs hardness of approx. 6). If hard fillers, e.g. silica flour (hardness 7), are used, processing leads to metal being abraded, preferably in the form of chips in the submillimeter range. These are incorporate in the insulation and, on account of their acicular geometry, lead to locations where the electric field strength is locally very greatly increased, where experience has shown that an electrical breakdown can occur. Microscopic tests revealed a density per unit area of such metallic particles of 1–3/100 $mm^2$ when $SiO_2$ is used as coarse filler.

The abrasion is avoided by the use of "soft" fillers (Mohs hardness ≦4), such as for example chalk dust, and/or using relatively fine fillers with $d_{50}$<<1 μm. Furthermore, fine fillers of this type have the advantage that, even if defects such as cavities or metallic inclusions are present, they prevent electrical breakthroughs or can at least delay them very considerably (cf. in this respect U.S. Pat. No. 4,760,296, DE 40 37 972 A1). In both these documents, the effective increase in the service life is achieved by completely or partially replacing the coarse filler with fillers with grain sizes in the nanometer range (0.005 to 0.1 μm maximum grain size). However, nanofillers have the unacceptable property of greatly increasing the melt viscosity of the powder mixture (thixotropy effect). This causes problems both during production of the powder and during its processing. For the present application, it has been found that $TiO_2$ powder with mean grain sizes of approx. 0.2 μm as complete or partial replacement for coarse fillers does not disadvantageously increase the melt viscosity yet nevertheless has the effect of increasing the service life in the same way as nanofillers. In this way, it has been possible to achieve an insulation with low electrical aging.

To avoid abrasion of metal, it would also be possible to provide all the surfaces which come into contact with the insulating material with a protective covering, e.g. with a ceramic covering, or to produce certain production means from ceramic, for example. However, complete or partial replacement of metal parts in this way is currently very expensive. Although abrasion does not affect the electric field and therefore the insulating action when, for example, ceramic surfaces are used, the rule nevertheless applies that the coarse filler should have a hardness which is at least one unit of Mohs hardness below that of the production means or container, i.e. given a ceramic coating with a hardness of usually about 8, the Mohs hardness of the filler should be at most approximately 7.

The electrically insulating inorganic fillers are preferably selected from carbonates, silicates and metal oxides, which may also be present in the form of comminuted minerals. Examples of such fillers include $TiO_2$, $CaCO_3$, ZnO, wollastonite, clay and talc; $TiO_2$, ZnO and clay are particularly suitable as fine fillers, and $CaCO_3$, wollastonite and talc with grain sizes of around approx. 10 μm (mean grain size $d_{50}$) are particularly suitable as coarse fillers.

Fillers of the desired grain size can be obtained in various ways, for example by special precipitation methods, combustion processes, etc., but also by mechanical comminution, in which case, if necessary, all these processes can be coupled to a fractionation or screening process.

The risk of abrasion caused by the use of hard fine filler is much less critical, since fine-grained abrasives are generally much less effective than coarse-grained abrasives.

The presence of at least 5 per cent by weight of filler and at least 3 per cent by weight, preferably at least 5 per cent by weight, of fine filler is important, since the filler has an electrically insulating action, increases the mechanical strength, improves the thermal conductivity, lowers the coefficient of thermal expansion, increases the UV stability and contributes to setting a suitable viscosity. Moreover, the fine filler is of importance with a view to increasing the corona resistance, while the coarse filler allows an increase in filler content with less of an increase in viscosity than with fine filler. Filler contents of over 50 per cent by weight, based on fillers with a closed density of up to 4 $g/cm^3$ and a maximum grain size of 20 μm, and also excessively high fine filler contents are critical, since problems arise as a result of an excessively high viscosity both during production of the insulating material and during processing of this material.

In the cured state, preferred thermosets for the matrix of the insulating materials of the present invention have a glass transition temperature of 130° C.–200° C., preferably 150° C.–180° C.

Since the insulating material according to the invention has to be free from bubbles or at least as far as possible free from bubbles, in order to achieve a good insulating action as is required for the preferred applications, the resin-hardener-auxiliary system of the thermoset should be such that it cures without volatile substances being released.

To prevent the formation of bubbles during curing, it is also preferred for the resin-hardener-auxiliary system to have a gel time which at least allows water which has been adsorbed in this system or at the surface which is to be coated, or other volatile substances, to escape from the insulation layer before the latter has solidified excessively, so that any pores or bubbles which form during this escape can be closed again.

The mixture of resin, hardener and organic auxiliaries should have a melting point of at most 200° C.; above all, it is important for the melting point to be below the activation temperature of the curing reaction or for the curing reaction to proceed very slowly at the melting point, while it can be substantially stopped during cooling. This is necessary in order to prevent extensive curing as early as during production of the insulating material. The curing properties can be adjusted by the addition of suitable materials; it should be ensured that such materials have a low volatility or are completely expelled in gas form within the gel time. It is preferable for the mixture of resin, hardener and organic auxiliaries to have a melting point of at least 50° C., in particular of 70° C.–120° C. Under exceptional circumstances, the melting point of resin and/or hardener may be up to 200° C. However, such a high melting point causes problems on account of the activation of the curing reaction, which usually takes place in a similar or even lower range. The curing usually takes place in a temperature range from 70° C. to 250° C., preferably in a range from 130° C. to 200° C.

To enable the high demands imposed on the glass transition temperature of the thermoset to be satisfied, it is preferable for the thermoset to be strongly crosslinked or to have a high crosslinking density. A preferred thermoset is an epoxy resin. Epoxy resin is preferred, inter alia, because both carboxylic anhydride and amine curing take place without volatile substances being released from the resin or the hardener. Furthermore, epoxy resin is usually crosslinkable, and, the crosslinking density can be increased by using dianhydrides or polyanhydrides or polyamines as hardeners and/or multifunctional, branched epoxy resins as the resin. To reduce the volatility of the components and to increase the glass transition temperature, resins and/or hardeners which contain aromatic groups are preferred.

As has already been indicated above, the insulating material according to the invention may contain additives and/or auxiliaries, such as activators, accelerators, pigments, etc. , such materials preferably having a low volatility.

For some applications of the new insulation, in particular in the field of rotating electrical machines, it is necessary for the insulation to be used in thermal class H ($T_{max}$=180° C.). For this purpose, the glass transition temperature ($T_g$) should lie in this temperature range, preferably between 130° C. and 200° C. Glass transition temperatures of significantly higher than 200° C. are on the one hand difficult to achieve and on the other hand lead to a material which is very brittle in the region of room temperature. To satisfy the demand for a Class H mechanical stability, in addition to a $T_g$ in the region of 180° C., the filler content is also important, and for such high demands should be >10 per cent by volume, which corresponds to approximately 23 per cent by weight, given a closed density of 4 g/cm$^3$.

An insulation for the medium-voltage and lower high-voltage range of electrical conductors which are subject to high thermal and electrical loads is preferably produced by at least partially covering the electrical conductors which are to be coated with an insulating material according to the invention, whereupon the insulating material is brought to a temperature which is higher than the melting and activation temperature for the curing of the resin-hardener-auxiliary system of the thermoset, at which temperature it is held until gelation occurs. The powder can be applied in various ways, for example by spraying with or without electrostatic charging or in a fluidized bed.

The freedom from bubbles referred to above is determined both by the choice of procedure and by various materials properties. It is important for the insulating material in the liquid state to have a sufficiently low viscosity to run and for the gel time to be long enough for all the bubble-forming admixtures (e.g. adsorbed water) to be able to evaporate. This requirement for long gel times contradicts the trend in powder coating which, in order to achieve high throughput times for thin-film coating, is to deliberately set low gel times (typically 15 seconds (s)) by adding accelerators. However, by reducing the accelerator content, the gel times of commercially available powders can be brought to times of ≧60 s, preferably 80–160 s, without difficulties, and such times are sufficiently long for the present application. In the case of spray powders, the viscosity is generally not measured and specified as a separate parameter; rather, instead what is known as the run, which results from the viscosity and gel time, is specified. Accordingly, bubble-free layers are achieved if the run is >25 mm, preferably 30–50 mm.

To additionally minimize and preferably completely prevent the formation of bubbles caused by volatile substances which are present at least at the surface of the electrical conductor which is to be coated and/or in the insulating material (e.g. adsorbed and absorbed water), it has proven extremely advantageous for the insulation to be applied in layers, the thickness of an individual layer being 0.05–0.3 mm, preferably 0.2 mm.

To build up layers with a thickness of >0.2 mm, the application of the individual layers is repeated until the desired layer thickness is reached. After each layer has been applied, the temperature of the system consisting of resin, hardener, auxiliaries and fillers is controlled in accordance with its gel time for approx. 60–300 s, resulting in melting, the release of water and partial curing. Moreover, the use of different powder compositions can result in locally different passages within the individual layers or locally different layer thicknesses of the entire insulation. In this way, the insulation can be optimally matched to the surface which is to be coated.

EXEMPLARY EMBODIMENTS

EXAMPLE 1

An epoxy resin powder which contains 40 per cent by mass of $TiO_2$ with a mean grain size $d_{50}$=0.2 μm was used to apply an insulation with a thickness of 0.5 mm to Cu plates of 200 mm×200 mm. The powder was not optimized with regard to slow gel times and therefore included bubbles with diameters of up to 0.3 mm. Electrodes with a diameter of 80 mm were applied to the plates. Then, the specimens were aged under oil at 16 kV/mm. On account of the bubbles, partial discharges (PDs) occurred in the specimens during the test. After 2600 hours (h), the tests were discontinued, without a breakdown having been observed.

In the comparison example, silica flour of $d_{50}$=10 μm was used as filler. In the aging test, none of the specimens achieved a service life of more than 1 h.

EXAMPLE 2

Cu sections with l/w/h=600×15×50 mm and an edge radius of 2.5 mm were coated with epoxy resin powder (with 35% of $TiO_2$ filler) and a run of 50 mm. The layer thickness was 0.5–1 mm. Apart from a small number of very small bubbles (<50 μm), the insulation is completely free of cavities, as demonstrated by microscopic examinations of sections. The PD inception stresses, defined by the detection of a PD level of >5 pC, were 18–25 kV/mm. The tan δ of the material remained below 10% in the range from room temperature to 200° C., so that there were only slight electric losses.

EXAMPLE 3

The same as Example 2, except that 35% of $CaCO_3$ with $d_{50}$ approx. 7 μm and only 5% of fine filler ($TiO_2$) were used as fillers. The results of the PD measurement were as good as those achieved in Example 2.

EXAMPLE 4

The specimens produced in 2 and 3 were subjected to an electrical life test. The result of the test is shown in the only figure. There is no significant difference in terms of the two types of filler. Most of the data points shown correspond to specimens which have not yet broken down; the service life curve which can ultimately be achieved is therefore even less steep than that which is illustrated in the figure. In cases in which a breakdown did occur, this was generally at the edge of the profiled section, where the field strength indicated is greater by a factor of 1.7 than the homogeneous field strength (referenced voltage U/d where d=layer thickness); this field increase factor is not included in the characteristic curve illustrated. The service life characteristic curve is extraordinarily shallow, which means that the material undergoes only slight electrical aging, and the long-term field strength, which leads to an expected service life of 20 years, is not significantly lower than the breakdown field strength measured in the accelerated test. The service life coefficient n was approx. 33.

EXAMPLE 5

An insulation with a total thickness of 10 mm was produced in 56 layers using epoxy resin powders containing 40% $TiO_2$ as fine filler.

What is claimed is:

1. A process for producing insulations for electrical conductors by powder coating with thermoset polymer powder comprising:

a) apply thermoset polymer powder to a conductor a plurality of times in succession, forming a plurality of individual layers, until a total insulation thickness of ≦10 mm is reached;

b) intermediate heat curing each of the individual layers before the next individual layer is applied, wherein the intermediate curing of each individual layer has a curing time which corresponds to 2–10 times the gel time of the powder used; and c) curing the entire insulation.

2. The process as claimed in claim 1, wherein the intermediate heat curing comprises a time which corresponds to 3–5 times the gel time of the powder used.

3. The process as claimed in claim 1, wherein individual layers are applied with a layer thickness of ≦0.5 mm.

4. The process as claimed in claim 3, wherein the individual layers are applied with a layer thickness of ≦0.3 mm.

5. The process as claimed in claim 1, wherein the individual layers are applied with a uniform layer thickness.

6. The process as claimed in claim 1, wherein individual layers with different layer thicknesses are applied.

7. The process as claimed in claim 1, wherein the powders used to apply the individual layers are of different composition.

8. The process as claimed in claim 1, wherein the step of applying powder further comprises applying powder by a process selected from the group consisting of spray-sintering and fluidized-bed sintering.

9. The process as claimed in claim 1, wherein the step of applying powder further comprises applying powder in a molten state by thermal spraying.

10. The process as claimed in claim 1, wherein applying powder comprises applying a powder comprising:

at least one resin-hardener-auxiliary system which can be melted and cured;

at least one inorganic filler wherein the inorganic filler content is 5–50 per cent by weight, based on a closed density of the filler of up to 4 g/cm3; and wherein at least 3 per cent by weight of the total mixture of the powder comprises fine filler with a mean grain size d50 of <3 $\mu$m, and the remaining filler comprises coarse filler with a mean grain size d50 of <30 $\mu$m, such that a run of the powder which melts to form a continuous film is at least 25 mm, and a gelation time of the melted powder is at least 40 s.

11. The process as claimed in claim 4 wherein the individual layers are applied with a layer thickness of 0.2 mm.

* * * * *